US006447385B1

(12) United States Patent
Togawa et al.

(10) Patent No.: US 6,447,385 B1
(45) Date of Patent: Sep. 10, 2002

(54) POLISHING APPARATUS

(75) Inventors: Tetsuji Togawa; Nobuyuki Takada, both of Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/605,989

(22) Filed: Jun. 29, 2000

(30) Foreign Application Priority Data

Jun. 30, 1999 (JP) ..... 11-185357

(51) Int. Cl.[7] ..... B24B 5/00
(52) U.S. Cl. ..... 451/397; 451/285; 451/287
(58) Field of Search ..... 451/397, 285, 451/287, 270, 271, 398, 41

(56) References Cited

U.S. PATENT DOCUMENTS 5,562,524 A 10/1996 Gill, Jr.
5,649,854 A 7/1997 Gill, Jr.
5,738,574 A 4/1998 Tolles et al.
5,951,373 A * 9/1999 Shendon et al. ..... 451/41
5,989,107 A * 11/1999 Shimizu et al. ..... 451/57
6,110,024 A * 8/2000 Togawa ..... 451/285
6,241,585 B1 * 6/2001 White ..... 451/41

* cited by examiner

*Primary Examiner*—Joseph J. Hail, III
*Assistant Examiner*—Hadi Shakeri
(74) *Attorney, Agent, or Firm*—Wenderoth, Lind & Ponack, L.L.P.

(57) ABSTRACT

A polishing apparatus applicable to a dry-in/dry-out polishing system is capable of increasing the capacity of processing substrates to be polished, e.g. semiconductor wafers, per unit of time and per unit area of installation. A polishing unit includes a turntable having a polishing surface, and at least two wafer carriers each adapted to hold a wafer and to press the wafer against the polishing surface. Each wafer carrier is supported by a pivot shaft and movable between a polishing position where the wafer is polished on the turntable and a transfer position for transferring the wafer. The at least two wafer carriers can be situated at the polishing position simultaneously and also alternately.

11 Claims, 6 Drawing Sheets

WC
POLISHING
(120 SEC.)
PREPARATORY OPERATION
(70 SEC.)
POLISHING
TABLE IDLE TIME

WC1-1
WC1-2
POLISHING
(120 SEC.)
PREPARATORY OPERATION
(70 SEC.)
STAND-BY
(50 SEC.)
POLISHING
PREPARATORY OPERATION
STAND-BY
POLISHING

WC1-1
WC1-2
POLISHING
(120 SEC.)
PREPARATORY OPERATION
(70 SEC.)
POLISHING
POLISHING
PREPARATORY OPERATION
POLISHING

WC1-1
WC1-2
POLISHING
(120 SEC.)
PREPARATORY OPERATION
(70 SEC.)
POLISHING

POLISHING APPARATUS

BACKGROUND OF THE INVENTION

The present invention relates to a polishing apparatus and method for polishing a surface of a work-piece such as a semiconductor wafer to a high degree of fineness.

In a semiconductor device manufacturing process, a polishing apparatus is used to polish surfaces of semiconductor wafers. However, during polishing particles become detached from the wafer and scattered around the polishing apparatus, and hence it has not been possible to use a conventional polishing apparatus in a clean room environment. In addition, in the conventional system, following polishing, the wafer is placed in a mobile water tank for transportation to a cleaning apparatus, which is inefficient in terms of both the time and space required to complete a polishing and cleaning operation.

To solve the above-mentioned problems, a so-called dry-in/dry-out system has been developed in which polishing and cleaning processes are carried out in an apparatus enclosed within a housing. In the dry-in/dry-out system, a semiconductor wafer is loaded into the apparatus in a dry state and, following polishing and cleaning, is unloaded in a dry state.

Aside from the development of the dry in/dry out system, a polishing apparatus per se has been modified such that it is able to be used in a clean room. Further, improvements in the processing efficiencies of a polishing apparatus and a cleaning apparatus have enabled their installation in a space equal to or smaller than that required for the installation of a dry-in/dry-out system. However, there remains a difficulty in the automation of the wafer transportation means incorporating a mobile water tank.

SUMMARY OF THE INVENTION

An object of the present invention is to provide a polishing apparatus which is applicable to the above-described dry-in/dry-out polishing system whereby the efficiency with which work-pieces are polished, such as semiconductor wafers, can be increased both in terms of the time required and space utilized.

In accordance with the present invention, there is provided a polishing apparatus comprising a polishing unit including a turntable provided on one side surface with a polishing surface and first and second substrate carriers each adapted to hold a substrate and to bring the substrate into contact with the polishing surface. Each of the first and second substrate carriers is movable between a first position where the substrate carrier receives a substrate and a second position where the substrate carrier is positioned over the polishing surface and is able to bring the substrate into contact with the polishing surface of the turntable. The first substrate carrier is movable between its first and second positions stated above while the second substrate carrier is positioned at its second position and vice versa.

The polishing apparatus may include first and second pivotal arms which support the first and second substrate carriers, respectively, to enable the first and second substrate carriers to move between their first and second positions stated above.

The second position stated above may include a polishing position where the substrate held by the substrate carrier is kept in contact with the polishing surface of the turntable and a waiting position where the substrate held by the substrate carrier is spaced away from the polishing surface.

The stated polishing unit may comprise a substrate transfer device for receiving substrates to be polished from the outside and positioning the substrates to enable the first and second substrate carriers to respectively pick up and hold the substrates. The wafer transfer device may be adapted to receive substrates which have been polished from the first and second substrate carriers positioned at their first positions.

The polishing unit may comprise first and second wafer transfer devices for receiving substrates to be polished from the outside and positioning the substrates to enable the first and second substrate carriers to pick up and hold the substrates, respectively. The wafer transfer devices may be adapted to receive substrates which have been polished from the first and second substrate carriers positioned at their first positions stated above.

In accordance with another aspect of the present invention, there is provided a polishing apparatus comprising a polishing unit including a turntable provided on one side surface with a polishing surface, and two substrate carriers each including a pivotal shaft, an arm having a center portion supported by the pivotal arm and opposite ends, and first and second substrate carriers provided on the opposite ends of the arm which are adapted to hold substrates, respectively. Each of the arms of the substrate carrier are pivotable about the pivotal shafts in such a manner that, in a first pivotal position, one of the first and second substrate carriers receives a substrate to be polished, while the other of the first and second substrate carriers is positioned over the polishing surface to enable the other substrate carrier to bring the substrate held thereby into contact with the polishing surface of the turntable, and in a second pivotal position, the other substrate carrier stated above receives a substrate to be polished, while the one substrate carrier stated above is positioned over the polishing surface to enable the one substrate carrier to bring the substrate held thereby into contact with the polishing surface of the turntable. The arms are movable between their first and second positions stated above without contacting each other.

The polishing unit may include a substrate transfer device for receiving substrates to be polished from the outside and positioning the substrates to enable the first and second substrate carriers to pick up and hold the substrates. The wafer transfer device may be adapted to receive substrates which have been polished from the first and second substrate carriers. The polishing unit may comprise two substrate transfer devices for respectively receiving substrates to be polished from the outside and positioning the substrates to enable the first and second substrate carriers to pick up and hold the substrates, respectively. The wafer transfer devices may be adapted to receive substrates which have been polished from the first and second substrate carriers.

According to a further aspect of the present invention, there is provided a polishing method comprising the steps of providing a turntable provided on its one side surface with a polishing surface, providing first and second substrate carriers each adapted to hold a substrate and to bring the substrate into contact with the polishing surface, turning the turntable, holding a substrate with the first substrate carrier, moving the first substrate carrier to bring the substrate held thereby into contact with the polishing surface to subject the substrate to polishing, and holding a substrate and then positioning the substrate over the polishing surface with the second substrate carrier, while the first substrate carrier keeps the substrate held thereby in contact with the polishing surface. Following completion of the polishing of the substrate held by the first substrate carrier, the substrate held by the second substrate carrier can be brought into contact with the polishing surface to subject the substrate to polishing without delay.

In accordance with the other aspect of the present invention, there is provided a polishing method comprising the steps of providing a turntable provided on its one side surface with a polishing surface, providing first and second substrate carriers each adapted to hold a substrate and to bring the substrate into contact with said polishing surface, turning the turntable, holding substrates by the first substrate carrier, moving the first substrate carrier to bring the substrate held thereby into contact with the polishing surface to subject the substrate to polishing, holding a substrate by the second substrate carrier and then bringing the substrate held by the second substrate carrier into contact with the polishing surface, while the first substrate carrier keeps the substrate held thereby in contact with the polishing surface, and moving the first substrate carrier to separate the substrate held thereby from the polishing surface following completion of polishing thereof, then exchanging the polished substrate with another substrate and bringing it into contact with the polishing surface, while the second substrate carrier keeps the substrate held thereby in contact with the polishing surface.

The above and other features and advantages of the present invention will become apparent from the following description and the appended claims taken in conjunction with the accompanying drawings.

BRIEF DESCRIPTION OF THE DRAWINGS

FIG. 3 shows polishing start timing charts, in which: FIG. 3(*a*) is a timing chart showing polishing start timing in a typical conventional polishing apparatus; FIG. 3(*b*) is a timing chart showing polishing start timing in one example of the first embodiment of the polishing apparatus according to the present invention; FIG. 3(*c*) is a timing chart showing polishing start timing in another example of the first embodiment of the present invention; and FIG. 3(*d*) is a timing chart showing polishing start timing in still another example of the first embodiment of the present invention.

DESCRIPTION OF THE PREFERRED EMBODIMENTS

Embodiments of the polishing apparatus according to the present invention will now be described below with reference to the accompanying drawings.

Figure 1:
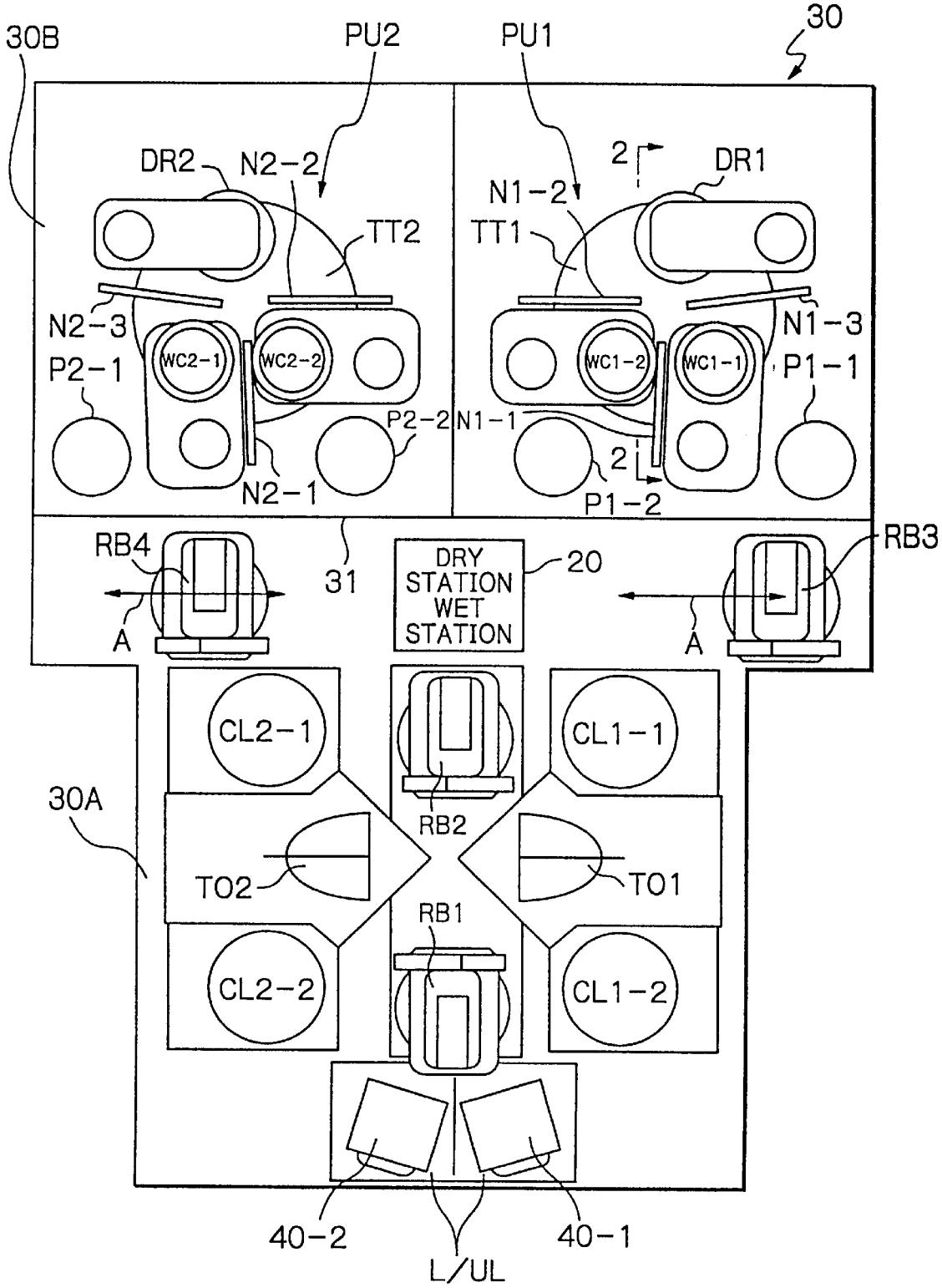
FIG. 1 is a plan view showing an arrangement of each part of a first embodiment of a polishing apparatus according to the present invention.

FIG. 1 is a plan view of a first embodiment of a polishing apparatus according to the present invention.

The polishing apparatus shown in FIG. 1 has two rotatable loading/unloading stages L/UL for placing wafer cassettes 40-1 and 40-2 each stocked with a large number of semiconductor wafers. A transfer robot RB1 having two hands is disposed at a position where the robot hands can reach the wafer cassettes 40-1 and 40-2 on the loading/unloading stages L/UL.

Of the two hands of the transfer robot RB1, the upper hand holds a dry semiconductor wafer, and the lower hand holds only a wet wafer. Cleaning machine CL1-2 and CL2-2 for cleaning and drying a polished semiconductor wafer are disposed on either side of the transfer robot RB1 respectively, within reach of the robot hands. Turning-over machines TO1 and TO2 for turning over a semiconductor wafer are disposed within reach of the robot hands RB1.

The turning-over machine TO1 has a chucking mechanism for chucking a semiconductor wafer and a turning-over mechanism for turning a semiconductor wafer upside down. The turning-over machine TO1 handles only clean semiconductor wafers, while the turning-over machine TO2, in addition to a chucking mechanism and a turning-over mechanism, includes a rinsing mechanism for washing semiconductor wafers. The turning-over machine TO2 handles only contaminated semiconductor wafers.

A second transfer robot RB2 provided with two hands is positioned in substantially symmetric relation to the transfer robot RB1, as viewed along an imaginary line between the turning-over machines TO1 and TO2, respectively. The transfer robot RB2 is disposed at a position where its hands can reach the turning-over machines TO1 and TO2. Of the two hands of the transfer robot RB2, the upper hand is employed for holding dry semiconductor wafers, while the lower hand holds wet wafers.

Two cleaning machines CL1-1 and CL2-1 for cleaning a polished semiconductor wafer are disposed on either side of the transfer robot RB2. These cleaning machines are different from CL1-2 and CL2-2 in the cleaning operation conducted thereby. Cleaning machines CL1-1 and CL2-1 are installed for access by the hands of the transfer robot RB2. Two transfer robots RB3 and RB4, each provided with two hands, are disposed at opposite sides of the cleaning machines CL1-1 and CL2-1 relative to the turning-over machines TO1 and TO2. RB3 and RB4 can travel in directions indicated by the double-headed arrow A. The hands of RB3 are designed to access CL1-1. The hands of RB4 are designed to access CL2-1. A wafer station 20 is installed between RB3 and RB4. Wafer station 20 comprises both a dry and a wet station, and further is provided with a rinsing mechanism. Wafer station 20 is enclosed in a waterproof housing to contain splashes of rinsing water, and is provided on three sides with shuttered openings operative at the time of loading and unloading wafers.

The entire polishing apparatus is housed in housing 30 divided by a partition 31 into a cleaning chamber 30A, containing transfer robots RB3 and RB4 and the other above-stated devices, and a polishing chamber 30B.

Polishing unit PU1 is provided with a turntable TT1 and two wafer carriers WC1-1 and WC1-2, each of which are adapted to hold and bring a semiconductor wafer into engagement with a polishing surface on the turntable TT1. Loading/unloading pushers P1-1 and P1-2 are provided to transfer semiconductor wafers to wafer carriers WC1-2 and WC1-1, respectively. Polishing unit PU1 further includes a dresser DR1 for dressing or conditioning the polishing surface of the turntable TT1.

Polishing liquid nozzles N1-1 and N1-2 are provided to supply polishing liquid to the wafer carriers WC1-1 and WC1-2. A dressing liquid nozzle N1-3 is provided for the dresser DR1, and extends to a position approximately at the center of rotation of the turntable TT1.

The polishing unit PU2 includes a turntable TT2, two wafer carriers WC2-1 and WC2-2, a loading/unloading pusher P2-1, a loading/unloading pusher P2-2, a dresser DR2 and polishing liquid nozzles N2-1 and N2-2, which are equivalent to the turntable TT1, two wafer carriers WC1-1 and WC1-2, loading/unloading pusher P1-1, loading/unloading pusher P1-2, dresser DR1 and polishing liquid nozzles N1-1 and N1-2 of the polishing unit PU1, respectively, and arranged in the same manner as the latter elements.

Figure 2:
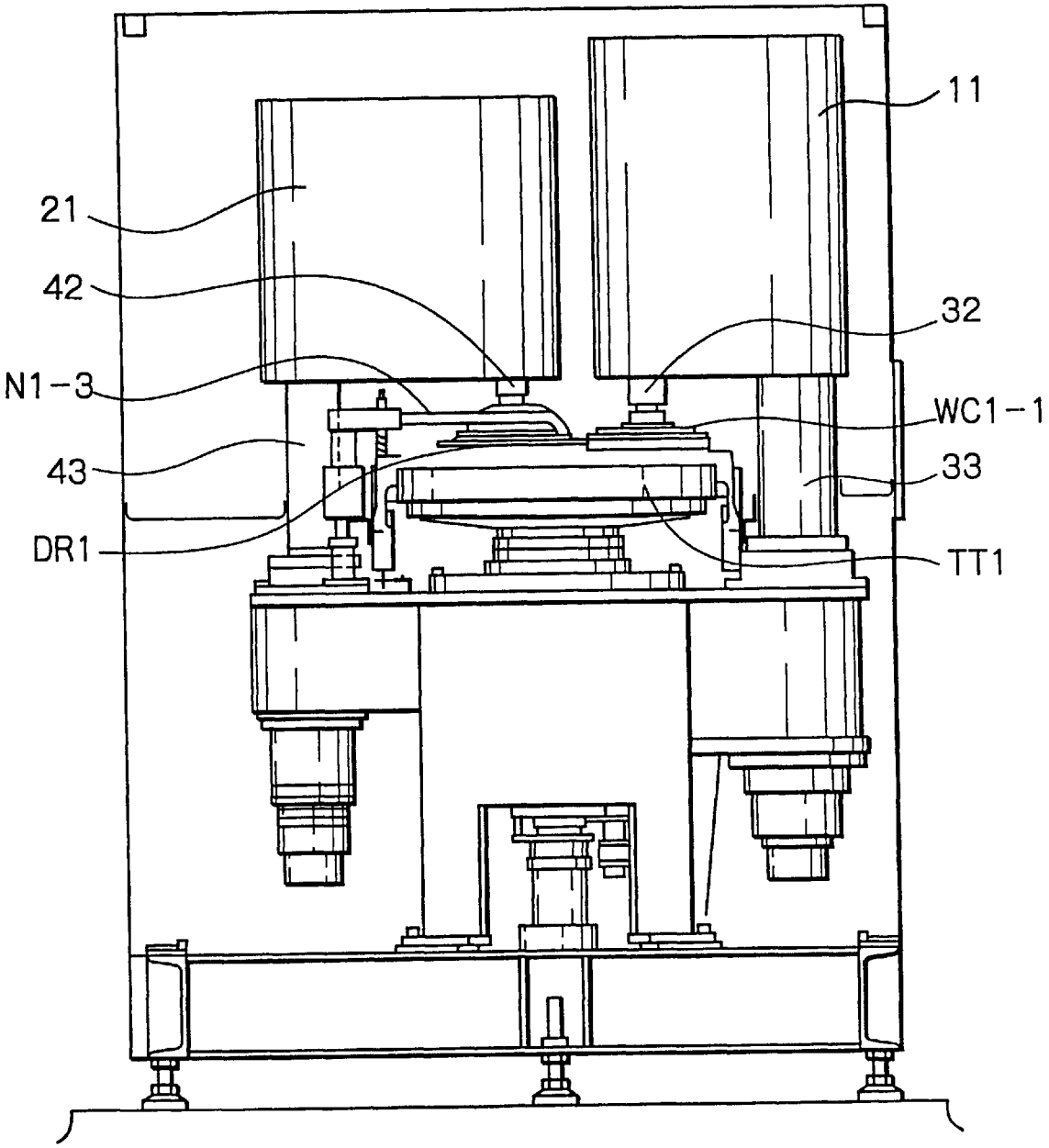
FIG. 2 is a view as taken in the direction of the arrow 2—2 in FIG. 1, which shows the relationship between a wafer carrier and a turntable for polishing.

FIG. 2 is a view taken in the direction of the arrow 2—2 in FIG. 1, and shows the relationship between a wafer carrier WC1-1 and the turntable TT1. As shown in FIG. 2, the wafer carrier WC1-1 is suspended from a wafer carrier arm 11 through a rotatable shaft 32. The wafer carrier arm 11 is supported through a pivot shaft 22, whereby the wafer carrier WC1-1 accesses the turntable TT1. An pneumatic cylinder provided in the wafer carrier arm 11 is operated to urge a semiconductor wafer held on the wafer carrier WC1-1 against the turntable TT1 under a desired load. The dresser DR1 is suspended from a dresser arm 21 through a rotatable shaft 42. The dresser arm 21 is supported by a pivot shaft 43 for positioning the dresser arm 21 with respect to the turntable TT1. A pneumatic cylinder is also provided in the dresser arm 21 to urge the dresser DR1 against the turntable TT1 under a desired load. The turntable TT1 has a polishing cloth or abrasive plate fitted to the upper surface thereof to provide a polishing surface. Although it is not shown, the arrangement of the wafer carrier WC1-2 is the same as that of the wafer carrier WC1-1. The wafer carriers WC2-1 and WC2-2 and the dresser DR2 are arranged in the same manner relative to the turntable TT2.

In the above-described arrangement, the two wafer carriers WC1-1 and WC1-2 in the polishing unit PU1 are supported by the respective pivot shafts 33, with each being movable between a polishing position where a semiconductor wafer is brought into contact with the turntable TT1 and a transfer position where semiconductor wafers are transferred between the wafer carriers WC1-1 and WC1-2 and the corresponding loading/unloading pushers P1-1 and P1-2. The two wafer carriers WC1-1 and WC1-2 can be positioned at the respective polishing positions either simultaneously or alternately.

As described previously, two polishing modes are available: one where a first wafer carrier WC1-1 is situated at a polishing position over the turntable TT1 to effect polishing of a wafer while the second wafer carrier WC1-2 loaded with a wafer transferred from the pusher P1-2 is situated at a transfer position ready for movement to the polishing position once polishing of a first wafer is complete; and a second mode where both first and second wafer carriers WC1-1 and WC1-2 are situated at polishing positions over the turntable TT1 to effect simultaneous polishing of two wafers. In the second polishing mode, differing time periods for a polishing operation can be set with respect to the wafer carriers WC1-1 and WC1-2 depending on the condition of the surface of the semiconductor wafer held thereby for polishing.

Although in the foregoing only the polishing unit PU1 has been described, it should be noted that the polishing unit PU2 is operated in the same manner as the polishing unit PU1.

An operation of the entire polishing apparatus arranged as stated above will be described below.

Semiconductor wafers to be polished are placed in the wafer cassettes 40-1 and 40-2. The wafer cassettes 40-1 and 40-2 are placed on the loading/unloading stages L/UL, respectively. Following input of data corresponding to processing conditions, the apparatus starts an automated operation as stated below.

1. The transfer robot RB1 picks up and holds a wafer 1 in the wafer cassette 40-1 with the dry hand, i.e. the upper one of its two hands and, then, takes out the wafer 1 from the wafer cassette 40-1. Thereafter, the transfer robot RB1 adjusts the angle and height of the hand holding the wafer 1 and, then, transfers the wafer 1 to the turning-over machine TO1.

2. The turning-over machine TO1 actuates its chucks to hold the wafer 1 transferred thereto by the transfer robot RB1. After it has been confirmed that the wafer 1 is securely held, the turning-over machine TO1 turns the wafer 1 through 180° so that a surface of the wafer 1 that is to be processed faces downward.

3. After it has been confirmed that the turning-over machine TO1 has turned the wafer 1 through 180°, the transfer robot RB2 adjusts the angle and height of the hands thereof. Then, the transfer robot RB2 opens the chucks of the turning-over machine TO1 and receives the wafer 1 with the upper one of its two hands. Thereafter, the transfer robot RB2 adjusts the angle and height of the upper hand and transfers the wafer 1 to the wafer station 20.

4. The wafer station 20 has a mechanism for sensing whether or not the wafer 1 has been accurately transferred thereto. After it has been confirmed that the wafer 1 has been accurately transferred to the wafer station 20, the transfer robot RB3 takes the wafer 1 out from the wafer station 20 and transfers the wafer 1 to the pusher P1-1.

5. At this time, the wafer carrier WC1-1 lies at a position above the pusher P, while the wafer carrier WC1-2 remains at a position outside the pivoting locus of the wafer carrier WC1-1. It is preferable that the wafer carrier WC1-2 stays at a polishing position over the turntable TT1.

6. After it has been confirmed that the wafer 1 has been transferred to the pusher P1-1, the pusher P1-1 moves toward the wafer carrier WC1-1 until the wafer 1 comes into contact with the wafer carrier WC1-1.

7. Next, the wafer 1 is transferred to the wafer carrier WC1-1 under the influence of a vacuum. After it has been confirmed that the wafer 1 has been transferred, the pusher P1-1 moves back to the previous position.

8. The wafer carrier WC1-1 pivots about its pivot shaft 33 to move to the polishing position and commences polishing of the wafer. Meanwhile, the above-described steps 1 to 4 are conducted to supply the pusher P1-2 with a wafer 2.

9. The commencement of the polishing operation by the wafer carrier WC1-1 triggers the wafer carrier WC1-2 to start pivoting towards the pusher P1-2. The wafer carrier WC1-2 stops pivoting at a position above the pusher P1-2 where a wafer can be transferred between the pusher P1-2 and the wafer carrier WC1-2.

10. The pusher P1-2 thereafter moves upwards until the wafer 2 held by the pusher comes into contact with the wafer carrier WC1-2.

11. Next, the wafer 2 is transferred to the wafer carrier WC1-2 by the action of a vacuum. After it has been confirmed that the wafer 2 has been transferred, the pusher p1-2 moves back to the previous position.

12. The wafer carrier WC1-2 pivots about its pivot shaft 33 to move to the polishing position and waits in this position until the polishing operation of the wafer carrier WC1-1 is completed. After the completion of the polishing of the wafer 1 held by the wafer carrier WC1-1, polishing of the wafer 2 by the wafer carrier WC1-2 is commenced. Meanwhile, the above-described operations at steps 1 to 4 are conducted, whereby a wafer 3 is held by the dry hand of the transfer robot RB3. The transfer robot RB3 stands by at a position where the wafer 3 can be transferred between the transfer robot RB3 and the pusher P1-1.

13. Regarding the timing at which the wafer carrier WC1-2 commences polishing at the above-described step 12, the polishing may be commenced immediately after the completion of the polishing by the wafer carrier WC1-1. It is also possible to carry out dressing for a desired period of time between the polishing processes. Dressing may be carried out for a desired period of time during the polishing operation.

14. After the completion of polishing, the wafer carrier WC1-1 holds the polished wafer 1 under the influence of vacuum and is pivoted towards the pusher P1-1 to finally separate the wafer 1 from the polishing surface and reaches a position above the pusher P1-1.

15. The pusher P1-1 moves toward the wafer carrier WC1-1 and stops at a position where a predetermined spacing is left between the pusher P1-1 and the wafer carrier WC1-1. Thereafter, the wafer carrier WC1-1 performs a wafer unloading operation to transfer the wafer 1 to the pusher P1-1. The wafer unloading operation is carried out by cutting off the vacuum applied to the wafer carrier WC1-1 and blowing a combination of air or nitrogen and pure water over the wafer carrier WC1-1. The pusher P1-1 having the wafer 1 transferred thereto moves down to a transfer position where the wafer is transferred from the pusher P1-1 to the transfer robot RB3.

16. In this state, rinsing of the wafer 1 and rinsing of the wafer carrier WC1-1 are carried out. The rinsing periods for the wafer 1 and the wafer carrier WC1-1 can be set as desired. However, it is desirable that the wafer rinsing time be not shorter than the wafer carrier rinsing time (wafer rinsing time≧wafer carrier rinsing time). The reason being that since the wafer carrier WC1-1 lies above the pusher P1-1, the rinsing liquid used for the wafer carrier WC1-1 falls onto the pusher P1-1. Therefore, it is necessary for liquid on the pusher P1-1 to be washed away from the pusher P1-1.

17. The transfer robot RB3 receives the wafer 1 from the pusher P1-1 with its lower, wet hand. In sequence, the transfer robot RB3 transfers another wafer 3 to the pusher P1-1 with its upper dry hand. The wafer transferred to the pusher is, then, subjected to the polishing operation as described above.

18. The transfer robot RB3 places the wafer 1 on the wet station in the wafer station 20. Subsequently, the transfer robot RB3 receives a wafer 4 from the dry station in the wafer station 20 and moves to a position where the transfer robot RB3 can transfer the wafer 4 to the pusher P1-2. The transfer robot RB3 repeats the series of operations as stated above.

19. The wafer 1 transferred to the wet station in the wafer station 20 may be rinsed again on the wet station. This reduces the amount of slurry and abrasive grains or particles which might be otherwise brought into the subsequent steps.

20. After the completion of rinsing on the wet station in the wafer station 20, the transfer robot RB2 takes out the rinsed wafer 1 with the lower, wet hand and transfers it to the cleaning machine CL1-1.

21. The cleaning machine CL1-1 is capable of cleaning both sides of a wafer simultaneously and can use an appropriate cleaning liquid (chemical liquid) at need.

22. The cleaned wafer 1 is taken out with the upper hand of the transfer robot RB2 and transferred to the turning-over machine TO2. The turning-over machine TO2 has a rinsing function to prevent the wafer from drying and is therefore capable of rinsing the wafer when it is turned over or during the period of time when the wafer waits for the transfer robot RB1 to come. It is possible to select and set a desired rinsing quantity and rinsing time and also possible to decide whether to perform rinsing continuously or intermittently.

23. The wafer 1 is turned over through 180° by the turning-over machine so that the surface thereof to be processed faces upward. The transfer robot RB1 receives the turned-over wafer 1 with the lower, wet hand and transfers it to the cleaning machine CL1-2. The cleaning machine CL1-2 may be a contact-type cleaning machine using a pencil-type sponge or the like, or a non-contact cleaning machine represented by a megasonic jet cleaning machine which may be selected in conformity with the preceding and/or subsequent steps and the kind of film formed on the wafer. The cleaning machine is provided with a spin-drying function.

24. The wafer 1 cleaned and dried by the cleaning machine CL1-2 is held under the influence of vacuum by the dry hand of the transfer robot RB1 and returned to the same slot in the original cassette.

25. The above-described series of operations are repeated, thereby allowing wafers to be processed continuously.

26. In the foregoing only the polishing unit PU1 has been described. As shown in FIG. 1, the polishing apparatus has two polishing units, and the operation sequences of the two polishing units are almost the same. In the foregoing description, all the wafers 1, 2 and 3 are transferred to the polishing unit PU1 and processed therein. When the throughput need not be very high, only either the polishing unit PU1 or PU2 may be used.

27. The polishing apparatus may be operated such that, of wafers taken out from a single cassette and transferred to the dry station in the wafer station 20, odd-numbered wafers are processed in the polishing unit PU1, and even-numbered wafers are processed in the polishing unit PU2. In such a case, odd-numbered wafers in the dry station of the wafer station 20 are taken out by the transfer robot RB3, and the even-numbered wafers are taken out by the transfer robot RB4.

28. Although in the above paragraph 27 a transfer pattern of wafers from one cassette has been discussed, limitations may be added such that wafers taken out from a cassette placed on one loading/unloading stage L/UL are processed in the polishing unit PU1, and wafers taken out from a cassette placed on the other loading/unloading stage L/UL are processed in the polishing unit PU2.

29. Although in the example shown in FIG. 1 the number of cassettes is 2, it may be a desired number, e.g. 4. In FIG. 1, the number of wafer carriers is 4. Therefore, the number of cassettes may also be 4. In that case, four cassettes can be associated with the four wafer carriers in one-to-one correspondence to each other for wafer processing history management.

In the polishing apparatus according to the present invention, during polishing by the wafer carrier WC1-1, the wafer carrier WC1-2 is in a position where it is freely movable between the pusher P1-2 and a position over the polishing surface of the turntable TT1 without interfering with the wafer carrier WC1-1. Accordingly, during polishing of a wafer by the wafer carrier WC1-1, the wafer carrier WC1-2 can transfer a polished wafer to the pusher P1-2 and receive a subsequent wafer to be polished from the pusher P1-2 and further move to a place directly above its polishing position to stand by for commencement of polishing.

With this arrangement, in which, during polishing by one wafer carrier, another wafer carrier can exchange wafers and move to a position above the polishing surface to stand by, it is possible to changeably set the polishing start timing of each of the wafer carriers WC1-1 and WC1-2 and the process menu to operate the apparatus. In the conventional polishing apparatus, during exchange of wafers, the polishing surface of the turntable is left unused. However, the above-described arrangement minimizes or eliminates idle time of the polishing surface while maintaining the merits of the single-wafer polishing apparatus, such as high polishing performance and ease of maintaining the wafer carriers. Accordingly, the overall throughput in the apparatus also increases.

Figures 3A, 3B, 3C, 3D:
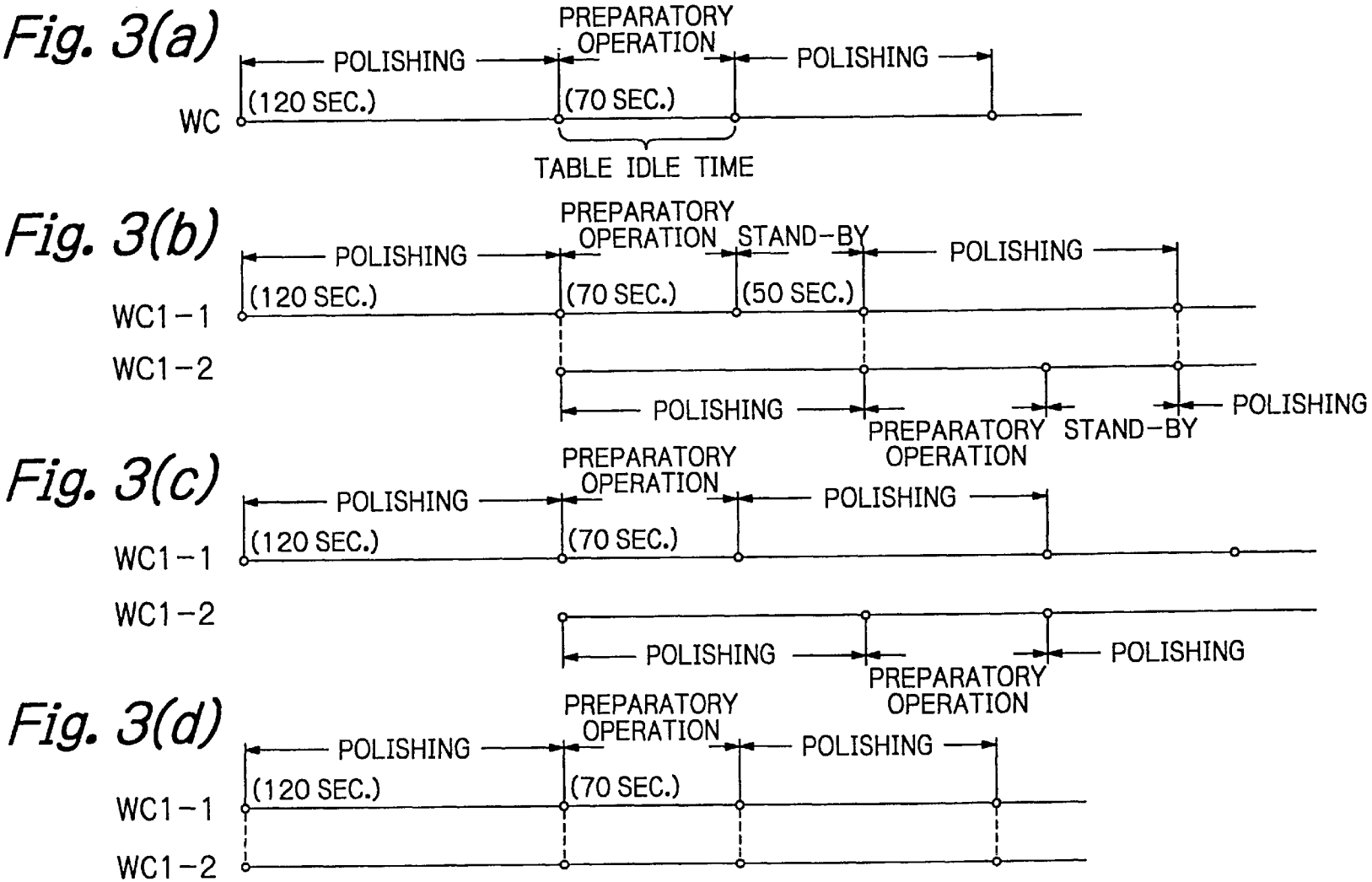

FIG. 3(*a*) is a timing chart showing the polishing start timing in a typical conventional polishing apparatus having one wafer carrier for one turntable. FIG. 3(*b*) is a timing chart showing the polishing start timing when wafers are polished as stated above in the polishing apparatus according to the first embodiment of the present invention. As shown in FIG. 3(*a*), if, in the conventional polishing apparatus, the polishing time is 120 seconds, for example, and the period of time required for other preparatory operations is 70 seconds, for example, 70 seconds is idle time of the turntable. The ratio of the period of time when one wafer is actually polished to the total processing time for the wafer becomes 120:190.

In contrast, the polishing apparatus according to the present invention can eliminate the idle time of the turntable. That is, as shown in FIG. 3(*b*), while one wafer carrier WC1-1 is polishing a wafer, another wafer carrier WC1-2 performs preparatory operations and stands by. Thus, upon completion of the polishing of the wafer by the wafer carrier WC1-1, polishing by the wafer carrier WC1-2 can commence. Accordingly, the ratio of the period of time when one wafer is actually polished to the total processing time for the wafer is 120:120. Thus, the idle time of the turntable can be reduced to zero.

It should be noted, however, that it is possible to perform a polishing operation with respect to two wafers without any stand-by time. FIG. 3(*c*) is a timing chart showing the polishing start timing in that case. That is, in this example, the periods of time of the polishing operations wafer carriers WC-1 and WC-2 overlap each other. As such, the polishing rate becomes higher than 120:120.

It is also possible to perform wafer polishing operations by the wafer carriers WC1-1 and WC1-2 in parallel. FIG. 3(*d*) is a timing chart showing the polishing start timing in the parallel polishing operation. That is, in this example, the wafer polishing operations by the wafer carriers WC1-1 and WC1-2 are simultaneously carried out in parallel, and thus polishing can be performed at a rate twice as high as that in the prior art.

Figure 4:
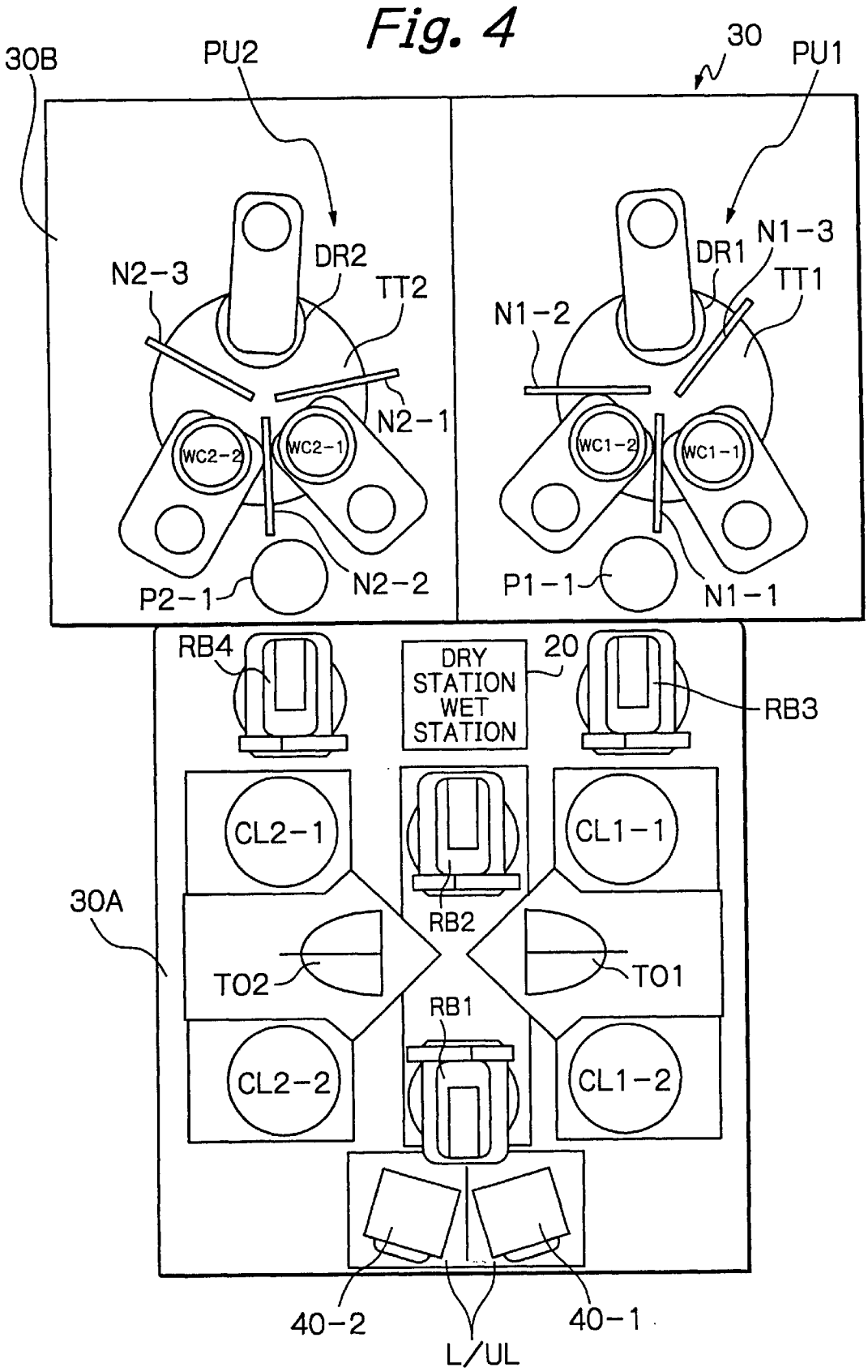
FIG. 4 is a plan view showing the arrangement of each part of a second embodiment of the polishing apparatus according to the present invention.

FIG. 4 is a plan view showing the arrangement of each part of a second embodiment of the polishing apparatus according to the present invention.

In the embodiment shown in FIG. 4, the polishing unit PU1 has a single pusher P1-1, and the polishing unit PU2 has a single pusher P2-1. Accordingly, in the polishing unit PU1, the pusher P1-1 functions as a transfer device common to the wafer carriers WC1-l and WC1-2. In the polishing unit PU2, the pusher P2-1 functions as a transfer device common to the wafer carriers WC2-1 and WC2-2.

In the embodiment shown in FIG. 4, each of the transfer robots RB3 and RB4 is of the type that does not travel. The arrangement of the rest of the embodiment is the same as that in the embodiment shown in FIG. 1. In this embodiment, transfer of a work-piece to be polished between the wafer carrier WC1-1 and the pusher P1-1 and the work-piece transfer between the wafer carrier WC1-2 and the pusher P1-1 are performed alternately. The relationship between the wafer carriers WC2-1 and WC2-2 on the one hand and the pusher P2-1 on the other is the same as in the case of the wafer carriers WC1-1 and WC1-2 and the pusher P1-1.

The operation of the entire polishing apparatus arranged as stated above will be described below.

Semiconductor wafers to be polished are put in the wafer cassettes 40-1 and 40-2. The wafer cassettes 40-1 and 40-2 are placed on the loading/unloading stages L/UL, respectively. After all processing conditions in the apparatus have been input, the apparatus starts an automated operation.

1. The transfer robot RB1 picks up and holds a wafer 1 in the wafer cassette 40-1 with the dry hand, i.e. the upper one of its two hands and, then, takes out the wafer 1 from the wafer cassette 40-1. Thereafter, the transfer robot RB1 adjusts the angle and height of the hand holding the wafer 1 and, then, transfers the wafer 1 to the turning-over machine TO1.

2. The turning-over machine TO1 actuates its chucks to hold the wafer 1 transferred thereto by the transfer robot RB1. After it has been confirmed that the wafer 1 is securely held, the turning-over machine TO1 turns the wafer 1 through 180° so that a surface of the wafer 1 that is to be processed faces downward.

3. After it has been confirmed that the turning-over machine TO1 has turned the wafer 1 through 180°, the transfer robot RB2 adjusts the angle and height of the hands thereof. Then, the transfer robot RB2 opens the chucks of the turning-over machine TO1 and receives the wafer 1 with the upper one of its two hands. Thereafter, the transfer robot RB2 adjusts the angle and height of the upper hand and transfers the wafer 1 to the wafer station 20.

4. The wafer station 20 has a mechanism for sensing whether or not the wafer 1 has been accurately transferred thereto. After it has been confirmed that the wafer 1 has been accurately transferred to the wafer station 20, the transfer robot RB3 takes the wafer 1 out from the wafer station 20 and transfers the wafer 1 to the pusher P1-1.

5. At this time, the wafer carrier WC1-1 lies at a position above the pusher P, while the wafer carrier WC1-2 remains at a position outside the pivoting locus of the wafer carrier WC1-1. It is preferable that the wafer carrier WC1-2 stays at a polishing position over the turntable TT1.

6. After it has been confirmed that the wafer 1 has been transferred to the pusher P1-1, the pusher P1-1 moves toward the wafer carrier WC1-1 until the wafer 1 comes into contact with the wafer carrier WC1-1.

7. Next, the wafer 1 is transferred to the wafer carrier WC1-1 under the influence of a vacuum. After it has been confirmed that the wafer 1 has been transferred, the pusher P1-1 moves back to the previous position.

8. The wafer carrier WC1-1 pivots about the pivot shaft 33 to move to the polishing position and a polishing operation commences. Meanwhile, the above-described operations at steps 1 to 4 are repeated to supply the pusher P1-1 with a wafer 2.

9. The fact that polishing with respect to the wafer carrier WC1-1 has commenced triggers the wafer carrier WC1-2 to start pivoting. The wafer carrier WC1-2 stops pivoting at a position above the pusher P1-1 where a wafer can be transferred between the pusher P1-1 and the wafer carrier WC1-2.

10. When the wafer 2 is on the pusher P1-1 and the wafer carrier WC1-2 is at a position above the pusher P1-1 where the wafer 2 can be transferred between the pusher P1-1 and the wafer carrier WC1-2, the pusher P1-1 moves toward the wafer carrier WC1-2 until the wafer 2 comes into contact with wafer carrier WC1-2.

11. Next, the wafer 2 is transferred to the wafer carrier WC1-2 by the action of a vacuum. After it has been confirmed that the wafer 2 has normally been transferred, the pusher p1-1 moves back to the previous position.

12. The wafer carrier WC1-2 pivots about its pivot shaft 33 to move to the polishing position and waits in this position until the polishing operation of the wafer carrier WC1-1 is completed. After the completion of the polishing of the wafer 1 held by the wafer carrier WC1-1, polishing of the wafer 2 by the wafer carrier WC1-2 is commenced. Meanwhile, the above-described operations at steps 1 to 4 are conducted, whereby a wafer 3 is held by the dry hand of the transfer robot RB3. The transfer robot RB3 stands by at a position where the wafer 3 can be transferred between the transfer robot RB3 and the pusher P1-1.

13. Regarding the timing at which the wafer carrier WC1-2 commences polishing at the above-described step 12, the polishing may be commenced immediately after the completion of the polishing by the wafer carrier WC1-1. It is also possible to carry out dressing for a desired period of time between the polishing processes. Dressing may be carried out for a desired period of time during the polishing operation.

14. After the completion of polishing, the wafer carrier WC1-1 holds the polished wafer 1 under the influence of vacuum, is pivoted towards the pusher P1-1 to finally separate the wafer 1 from the polishing surface and reaches a position above the pusher P1-1.

15. The pusher P1-1 moves toward the wafer carrier WC1-1 and stops at a position where a predetermined spacing is left between the pusher P1-1 and the wafer carrier WC1-1. Thereafter, the wafer carrier WC1-1 performs a wafer unloading operation to transfer the wafer 1 to the pusher P1-1. The wafer unloading operation is carried out by cutting off the vacuum applied to the wafer carrier WC1-1 and blowing a combination of air or nitrogen and pure water over the wafer carrier WC1-1. The pusher P1-1 having the wafer 1 transferred thereto moves down to a transfer position where the wafer is transferred from the pusher P1-1 to the transfer robot RB3.

16. In this state, rinsing of the wafer 1 and rinsing of the wafer carrier WC1-1 are carried out. The rinsing periods for the wafer 1 and the wafer carrier WC1-1 can be set as desired. However, it is desirable that the wafer rinsing time be not shorter than the wafer carrier rinsing time (wafer rinsing time≧wafer carrier rinsing time). The reason being that since the wafer carrier WC1-1 lies above the pusher P1-1, the rinsing liquid used for the wafer carrier WC1-1 falls onto the pusher P1-1. Therefore, it is necessary for liquid on the pusher P1-1 to be washed away from the pusher P1-1.

17. The transfer robot RB3 receives the wafer 1 from the pusher P1-1 with its lower, wet hand. In sequence, the transfer robot RB3 transfers another wafer 3 to the pusher P1-1 with its upper dry hand. The wafer transferred to the pusher is, then, subjected to the polishing operation as described above.

18. The transfer robot RB3 places the wafer 1 on the wet station in the wafer station 20. Subsequently, the transfer robot RB3 receives a wafer 4 from the dry station in the wafer station 20 and moves to the position where the transfer robot RB3 can transfer the wafer 4 to the pusher P1-1. The transfer robot RB3 repeats this series of operations.

19. The wafer 1 transferred to the wet station in the wafer station 20 may be rinsed again on the wet station. This reduces the amount of slurry and abrasive grains or particles which might be otherwise brought into the subsequent steps.

20. After the completion of rinsing on the wet station in the wafer station 20, the transfer robot RB2 takes out the rinsed wafer 1 with the lower, wet hand and transfers it to the cleaning machine CL1-1.

21. The cleaning machine CL1-1 is capable of cleaning both sides of a wafer simultaneously and can use an appropriate cleaning liquid (chemical liquid) at need.

22. The cleaned wafer 1 is taken out with the upper hand of the transfer robot RB2 and transferred to the turning-over machine TO2. The turning-over machine TO2 has a rinsing function to prevent the wafer from drying and is therefore capable of rinsing the wafer when it is turned over or during the period of time when the wafer waits for the transfer robot RB1 to come. It is possible to select and set a desired rinsing quantity and rinsing time and also possible to decide whether to perform rinsing continuously or intermittently.

23. The wafer 1 is turned over through 180° by the turning-over machine so that the surface thereof to be processed faces upward. The transfer robot RB1 receives the turned-over wafer 1 with the lower, wet hand and transfers it to the cleaning machine CL1-2. The cleaning machine CL1-2 may be a contact-type cleaning machine using a pencil-type sponge or the like, or a non-contact cleaning machine represented by a megasonic jet cleaning machine which may be selected in conformity with the preceding and/or subsequent steps and the kind of film formed on the wafer. The cleaning machine is provided with a spin-drying function.

24. The wafer 1 cleaned and dried by the cleaning machine CL1-2 is held under the influence of vacuum by the dry hand of the transfer robot RB1 and returned to the same slot in the original cassette.

25. The above-described series of operations are repeated, thereby allowing wafers to be processed continuously.

26. In the foregoing only the polishing unit PU1 has been described. As shown in FIG. 1, the polishing apparatus has two polishing units, and the operation sequences of the two polishing units are almost the same. In the foregoing description, all the wafers 1, 2 and 3 are transferred to the polishing unit PU1 and processed therein. When the throughput need not be very high, only one polishing unit, PU1 or PU2, may be used.

27. The polishing apparatus may be operated such that, of wafers taken out from a single cassette and transferred to the dry station in the wafer station 20, odd-numbered wafers are processed in the polishing unit PU1, and even-numbered wafers are processed in the polishing unit PU2. In such a case, odd-numbered wafers in the dry station of the wafer station 20 are taken out by the transfer robot RB3, and the even-numbered wafers are taken out by the transfer robot RB4.

28. Although in the above paragraph 27 a transfer pattern of wafers from one cassette has been discussed, limitations may be added such that wafers taken out from a cassette placed on one loading/unloading stage L/UL are processed in the polishing unit PU1, and wafers taken out from a cassette placed on the other loading/unloading stage L/UL are processed in the polishing unit PU2.

29. Although in the example shown in FIG. 4 the number of cassettes is 2, it may be some other number, e.g. 4. In FIG. 4, the number of wafer carriers is 4. Therefore, the number of cassettes may also be 4. In that case, four cassettes can be associated with the four wafer carriers in one-to-one correspondence to each other for wafer processing history management.

Figure 5:
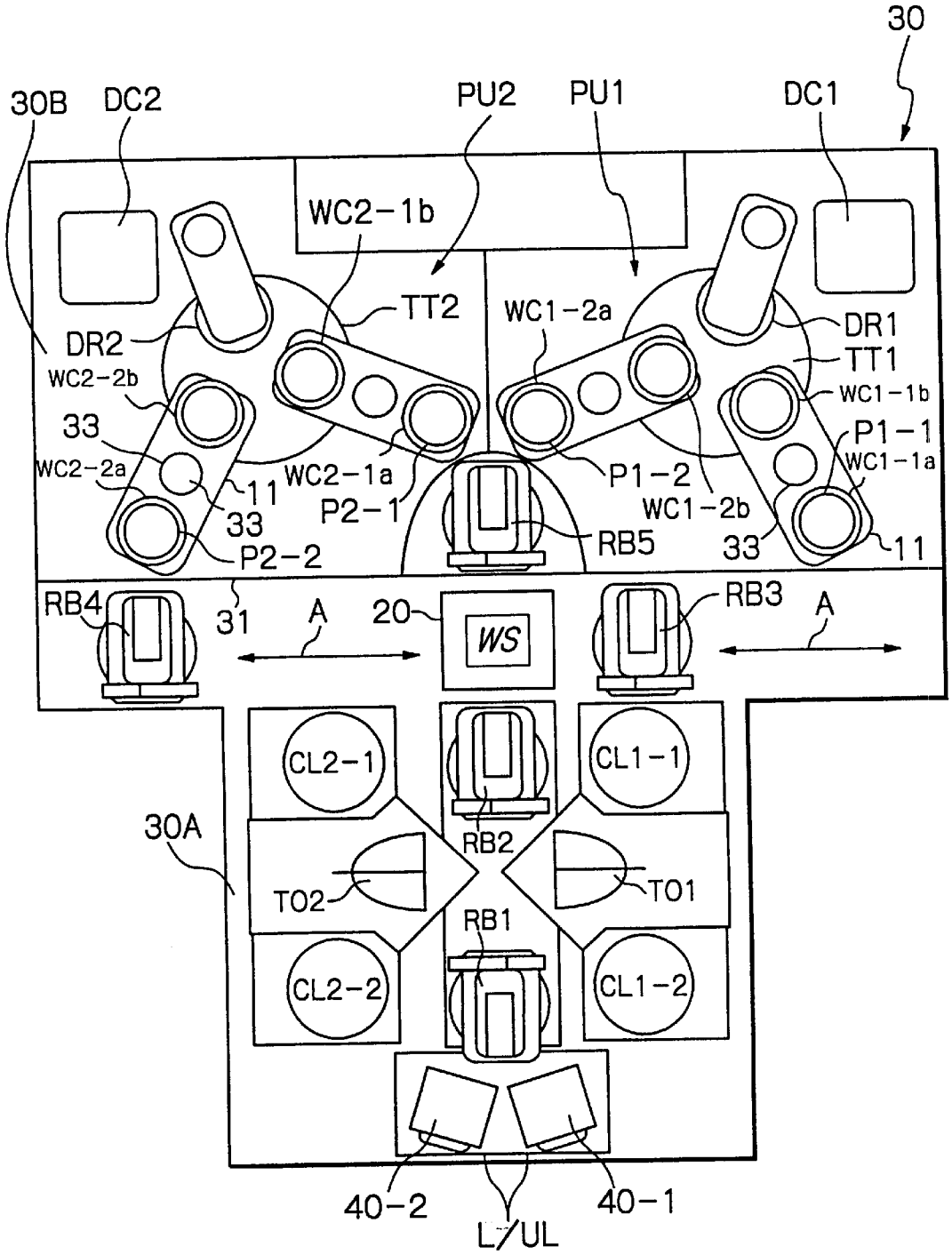
FIG. 5 is a plan view showing the arrangement of each part of a third embodiment of the polishing apparatus according to the present invention.

FIG. 5 is a plan view showing the arrangement of each part of a third embodiment of the polishing apparatus according to the present invention.

In the embodiment shown in FIG. 5, the polishing unit PU1 has two wafer carrier arms 11. One wafer carrier arm 11 has wafer carriers WC1-1*a* and WC1-1*b* at both ends thereof. The other wafer carrier arm 11 has wafer carriers WC1-2*a* and WC1-2*b* at both ends thereof. Similarly, the polishing unit PU2 has two wafer carrier arms 11. One wafer carrier arm 11 has wafer carriers WC2-1*a* and WC2-1*b* at both ends thereof. The other wafer carrier arm 11 has wafer carriers WC2-2*a* and WC2-2*b* at both ends thereof. Each wafer carrier arm 11 is supported at the center in the longitudinal direction thereof by a pivot shaft 33. With this arrangement, when the wafer carriers WC1-1*a* and WC1-2*a* in the polishing unit PU1 are at respective polishing positions, the wafer carriers WC1-1*b* and WC1-2*b* lie at wafer transfer positions above the pushers P1-1 and P1-2, respectively. In the polishing unit PU2, when the wafer carriers WC2-1*a* and WC2-2*a* are at respective polishing positions, the wafer carriers WC2-1*b* and WC2-2*b* lie at wafer transfer positions above the pushers P2-1 and P2-2, respectively. The positions of the wafer carriers at both ends of each wafer carrier arm 11 are interchanged with each other by turning the pivot shaft 33 back and forth intermittently through 180° in the horizontal direction.

In the embodiment shown in FIG. 5, a fifth transfer robot RB5 having two hands is provided at a position between the pusher P1-2 of the polishing unit PU1 and the pusher P2-1 of the polishing unit PU2. The transfer robot RB5 transfers wafers between the wafer station 20 and each of the pushers P1-2 and P2-1. The third transfer robot RB3 transfers wafers between the wafer station 20, the pusher P1-1 and the cleaning machine CL1-1. The fourth transfer robot RB4 transfers wafers between the wafer station 20, the pusher P2-2 and the cleaning machine CL2-1. It should be noted that, in the illustrated example, dresser cleaning tanks DC1 and DC2 are disposed at respective positions close to the dressers DR1 and DR2, and only one loading/unloading stage L/UL is provided. The arrangement of the rest of this embodiment is the same as that in the embodiment shown in FIG. 1.

The operation of the entire polishing apparatus arranged as stated above will now be described below. In this embodiment, operations carried out until a wafer has been transferred to the dry station in the wafer station 20 and operations carried out after the polished wafer has been transferred to the cleaning machine CL1-1 or CL2-1 are similar to those in the foregoing embodiments. Therefore, operations carried out after the wafer has been transferred to the wafer station 20 until the polished wafer has been transferred to the cleaning machine CL1-1 or CL2-1 will be described for each of three different types of parallel processing [parallel operations (1) to (3)] and two different types of serial processing [serial operations (1) and (2)].

A. Parallel Operation (1)

1. After it has been confirmed that the wafer 1 has been accurately transferred to the dry station in the wafer station 20, the transfer robot RB3 takes out the wafer 1 from the wafer station 20 and transfers the wafer 1 to the pusher P1-1.

2. At this time, the wafer carrier WC1-1*a* is at a position above the pusher P1-1 where a wafer can be transferred between the pusher P1-1 and the wafer carrier WC1-1*a*, while the wafer carrier WC1-1*b* is at the polishing position above the turntable TT1.

3. After it has been confirmed that the wafer 1 has been transferred to the pusher P1-1, the pusher P1-1 moves toward the wafer carrier WC1-1*a* until the wafer 1 comes into contact with wafer carrier WC1-1*a*.

4. Next, the wafer 1 is transferred to the wafer carrier WC1-1*a* by the action of a vacuum. After it has been confirmed that the wafer 1 has been transferred, the pusher P1-1 moves back to the previous position.

5. The wafer carrier WC1-1*a* pivots about the pivot shaft 33 through 180° in the horizontal direction to move to the polishing position and commences polishing. Meanwhile, as the pivot shaft 33 rotates, the wafer carrier WC1-1*b* moves to a position above the pusher P1-1 where a wafer can be transferred between the pusher P1-1 and the wafer carrier WC1-1*b*. A wafer 2 transferred to the pusher P1-1 in the same way as the above is transferred to the wafer carrier WC1-1*b* and held thereon under vacuum. The wafer carrier WC1-1*b* holding the wafer 2 stands by in this state.

6. Upon completion of the polishing of the wafer 1 held by the wafer carrier WC1-1*a*, the wafer carrier WC1-1*a* suction-holds the polished wafer 1 and is pivoted towards the pusher P1-1 to finally separate the wafer 1 from the polishing surface and reaches a position above the pusher P1-1.

7. The pusher P1-1 moves toward the wafer carrier WC1-1*a* and stops at a position where a predetermined spacing is left between the pusher P1-1 and the wafer carrier WC1-1*a*. Thereafter, the wafer carrier WC1-1*a* performs a wafer unloading operation to transfer the wafer 1 to the pusher P1-1. In this state, rinsing of the wafer 1 and rinsing of the wafer carrier WC1-1*a* are carried out. Meanwhile, as the pivot shaft 33 rotates, the wafer carrier WC1-1*b* moves to the polishing position, and polishing commences.

8. The transfer robot RB3 receives the wafer 1 from the pusher P1-1 by using the lower, wet hand. Next, the transfer robot RB3 transfers the wafer 1 to the cleaning machine CL1-1. The transfer robot RB3 repeats this series of operations.

B. Parallel Operation (2)

1. After it has been confirmed that the wafer 1 has been accurately transferred to the dry station in the wafer station 20, the transfer robot RB5 takes out the wafer 1 from the wafer station 20 and transfers the wafer 1 to the pusher P1-2 or P2-1.

2. At this time, the wafer carrier WC1-2*a* lies at a position above the pusher P1-2 where a wafer can be transferred between the pusher P1-2 and the wafer carrier WC1-2*a*, while the wafer carrier WC1-2*b* is at the polishing position above the turntable TT1. On the other hand, the wafer carrier WC2-1*a* is at a position above the pusher P2-1 where a wafer can be transferred between the pusher P2-1 and the wafer carrier WC2-1*a*, while the wafer carrier WC2-1*b* is at the polishing position above the turntable TT2.

3. After it has been confirmed that the wafer 1 has been transferred to the pusher P1-2 or P2-1, the pusher P1-2 or P2-1 moves toward the wafer carrier WC1-2*a* or WC2-1*a* until the wafer 1 comes into contact with wafer carrier WC1-2*a* or WC2-1*a*.

4. Next, the wafer 1 is transferred to the wafer carrier WC1-2*a* or WC2-1*a* by the action of a vacuum. After it has been confirmed that the wafer 1 has been transferred, the pusher P1-2 or P2-1 moves back to the previous position.

5. The wafer carrier WC1-2*a* or WC2-1*a* pivots about the pivot shaft 33 through 180° in the horizontal direction to move to the polishing position and commences polishing. Meanwhile, as the pivot shaft 33 rotates, the wafer carrier WC1-2*b* or WC2-1*b* moves to a position above the pusher P1-2 or P2-1 where a wafer can be transferred between the pusher P1-2 or P2-1 and the wafer carrier WC1-2*b* or WC2-1*b*. A wafer 2 transferred to the pusher P1-2 or P2-1 in the same way as the above is transferred to the wafer carrier WC1-2*b* or WC2-1*b* and held thereon under vacuum. The wafer carrier WC1-2*b* or WC2-1*b* holding the wafer 2 stands by in this state.

6. Upon completion of the polishing of the wafer 1 held by the wafer carrier WC1-2*a* or WC2-1*a*, the wafer carrier WC1-2*a* or WC2-1*a* suction-holds the polished wafer 1 and is pivoted towards the pusher P1-2 or P2-1 to finally separate the wafer 1 from the polishing surface and reach a position above the pusher P1-2 or P2-1 where the wafer 1 can be transferred between the wafer carrier WC1-2*a* or WC2-1*a* and the pusher P1-2 or P2-1.

7. The pusher P1-2 or P2-1 moves toward the wafer carrier WC1-2*a* or WC2-1*a* and stops at a position where a predetermined spacing is left between the pusher P1-2 or P2-1 and the wafer carrier WC1-2*a* or WC2-1*a*. Thereafter, the wafer carrier WC1-2*a* or WC2-1*a* performs a wafer unloading operation to transfer the wafer 1 to the pusher P1-2 or P2-1. In this state, rinsing of the wafer 1 and rinsing of the wafer carrier WC1-2*a* or WC2-1*a* are carried out. Meanwhile, as the pivot shaft 33 rotates, the wafer carrier WC1-2*b* or WC2-1*b* moves to the polishing position, and polishing is commenced.

8. The transfer robot RB5 receives the wafer 1 from the pusher P1-2 or P2-1 by using the lower, wet hand. Next, the transfer robot RB5 transfers the wafer 1 to the wet station in the wafer station 20. The transfer robot RB5 repeats this series of operations.

9. The wafer 1 transferred to the wet station in the wafer station 20 is transferred to the cleaning machine CL1-1 or CL2-1 by the transfer robot RB3 or RB4.

C. Parallel Operation (3)

1. After it has been confirmed that the wafer 1 has been accurately transferred to the dry station in the wafer station 20, the transfer robot RB4 takes out the wafer 1 from the wafer station 20 and transfers the wafer 1 to the pusher P2-2.

2. At this time, the wafer carrier WC2-2*a* is at a position above the pusher P2-2 where a wafer can be transferred between the pusher P2-2 and the wafer carrier WC2-2*a*, while the wafer carrier WC2-2*b* is at the polishing position above the turntable TT2.

3. After it has been confirmed that the wafer 1 has been transferred to the pusher P2-2, the pusher P2-2 moves toward the wafer carrier WC2-2*a* until the wafer 1 comes into contact with wafer carrier WC2-2*a*.

4. Next, the wafer 1 is transferred to the wafer carrier WC2-2*a* by the action of a vacuum. After it has been confirmed that the wafer 1 has been transferred, the pusher P2-2 moves back to the previous position.

5. The wafer carrier WC2-2*a* pivots about the pivot shaft 33 through 180° in the horizontal direction to move to the polishing position and commences polishing. Meanwhile, as the pivot shaft 33 rotates, the wafer carrier WC2-2*b* moves to a position above the pusher P2-2 where a wafer can be transferred between the pusher P2-2 and the wafer carrier WC2-2*b*. A wafer 2 transferred to the pusher P2-2 in the same way as the above is transferred to the wafer carrier WC2-2*b* and held thereon under vacuum. The wafer carrier WC2-2*b* holding the wafer 2 stands by in this state.

6. Upon completion of the polishing of the wafer 1 held by the wafer carrier WC2-2*a*, the wafer carrier WC2-2*a* suction-holds the polished wafer 1 and is pivoted towards the pusher P2-2 to finally separate the wafer 1 from the polishing surface and reaches a position above the pusher P2-2.

7. The pusher P2-2 moves toward the wafer carrier WC2-2*a* and stops at a position where a predetermined spacing is left between the pusher P2-2 and the wafer carrier WC2-2*a*. Thereafter, the wafer carrier WC2-2*a* performs a wafer unloading operation to transfer the wafer 1 to the pusher P2-2. In this state, rinsing of the wafer 1 and rinsing of the wafer carrier WC2-2*a* are carried out. Meanwhile, as the pivot shaft 33 rotates, the wafer carrier WC2-2*b* moves to the polishing position, and polishing commences.

8. The transfer robot RB4 receives the wafer 1 from the pusher P2-2 by using the lower, wet hand. Next, the transfer robot RB3 transfers the wafer 1 to the cleaning machine CL2-1. The transfer robot RB4 repeats this series of operations.

D. Serial Operation (1)

1. After it has been confirmed that the wafer 1 has been. accurately transferred to the dry station in the wafer station 20, the transfer robot RB5 takes out the wafer 1 from the wafer station 20 and transfers the wafer 1 to the pusher P1-2.

2. At this time, the wafer carrier WC1-2*a* is at a position above the pusher P1-2 where a wafer can be transferred between the pusher P1-2 and the wafer carrier WC1-2*a*, while the wafer carrier WC1-2*b* is at the polishing position above the turntable TT1.

3. After it has been confirmed that the wafer 1 has been transferred to the pusher P1-2, the pusher P1-2 moves toward the wafer carrier WC1-2*a* until the wafer 1 comes into contact with wafer carrier WC1-2*a*.

4. Next, the wafer 1 is transferred to the wafer carrier WC1-2*a* by the action of a vacuum. After it has been confirmed that the wafer 1 has been transferred, the pusher P1-2 moves back to the previous position.

5. The wafer carrier WC1-2*a* pivots about the pivot shaft 33 through 180° in the horizontal direction to move to the polishing position and commences polishing. Meanwhile, as the pivot shaft 33 rotates, the wafer carrier WC1-2*b* moves to a position above the pusher P1-2 where a wafer can be transferred between the pusher P1-2 and the wafer carrier WC1-2*b*. A wafer 2 transferred to the pusher P1-2 in the same way as the above is transferred to the wafer carrier WC1-2*b* and held thereon under vacuum. The wafer carrier WC1-2*b* holding the wafer 2 stands by in this state.

6. Upon completion of the polishing of the wafer 1 held by the wafer carrier WC1-2*a*, the wafer carrier WC1-2*a* suction-holds the polished wafer 1 and is pivoted towards the pusher P1-2 to finally separate the wafer 1 from the polishing surface and reaches a position above the pusher P1-2.

7. The pusher P1-2 moves toward the wafer carrier WC1-2*a* and stops at a position where a predetermined spacing is left between the pusher P1-2 and the wafer carrier WC1-2*a*. Thereafter, the wafer carrier WC1-2*a* performs a wafer unloading operation to transfer the wafer 1 to the pusher P1-2. In this state, rinsing of the wafer 1 and rinsing of the wafer carrier WC1-2*a* are carried out. Meanwhile, as the pivot shaft 33 rotates, the wafer carrier WC1-2*b* moves to the polishing position, and polishing commences.

8. The transfer robot RB5 receive s the wafer 1 from the pusher P-2 by using the lower, wet hand. Next, the transfer robot RB5 transfers the wafer 1 to the wet station in the wafer station 20. The transfer robot RB5 repeats this series of operations.

9. After it has been confirmed that the wafer 1 has been accurately transferred to the wet station in the wafer station 20, the transfer robot RB3 takes out the wafer 1 from the wafer station 20 and transfers the wafer 1 to the pusher P1-1.

10. At this time, the wafer carrier WC1-1*a* lies at a position above the pusher P1-1 where a wafer can be transferred between the pusher P1-1 and the wafer carrier WC1-1*a*, while the wafer carrier WC1-1*b* lies at the polishing position above the turntable TT1.

11. After it has been confirmed that the wafer 1 has been transferred to the pusher P1-1, the pusher P1-1 moves toward the wafer carrier WC1-1*a* until the wafer 1 comes into contact with wafer carrier WC1-1*a*.

12. Next, the wafer 1 is transferred to the wafer carrier WC1-1*a* by the action of a vacuum. After it has been confirmed that the wafer 1 has normally been transferred, the pusher P1-1 moves back to the previous position.

13. The wafer carrier WC1-1*a* pivots about the pivot shaft 33 through 180° in the horizontal direction to move to the polishing position and commences polishing. Meanwhile, as the pivot shaft 33 rotates, the wafer carrier WC1-1*b* moves to a position above the pusher P1-1 where a wafer can be transferred between the pusher P1-1 and the wafer carrier WC1-1*b*. A wafer 2 transferred to the pusher P1-1 in the same way as the above is transferred to the wafer carrier WC1-1*b* and held thereon under vacuum. The wafer carrier WC1-1*b* holding the wafer 2 stands by in this state.

14. Upon completion of the polishing of the wafer 1 held by the wafer carrier WC1-1*a*, the wafer carrier WC1-1*a* suction-holds the polished wafer 1 and is pivoted towards the pusher P1-1 to finally separate the wafer 1 from the polishing surface and reaches a position above the pusher P1-1 where the wafer 1 can be transferred between the wafer carrier WC1-1*a* and the pusher P1-1.

15. The pusher P1-1 moves toward the wafer carrier WC1-1*a* and stops at a position where a predetermined spacing is left between the pusher P1-1 and the wafer carrier WC1-1*a*. Thereafter, the wafer carrier WC1-1*a* performs a wafer unloading operation to transfer the wafer 1 to the pusher P1-1. In this state, rinsing of the wafer 1 and rinsing of the wafer carrier WC1-1*a* are carried out. Meanwhile, as the pivot shaft 33 rotates, the wafer carrier WC1-1*b* moves to the polishing position, and polishing is commenced.

16. The transfer robot RB3 receives the wafer 1 from the pusher P1-1 by using the lower, wet hand. Next, the transfer robot RB3 transfers the wafer 1 to the cleaning machine CL1-1. The transfer robot RB3 repeats this series of operations.

Although only the polishing unit PU1 has been explained in the foregoing description, the operation sequence in the polishing unit PU2 is almost the same as the above. In the polishing unit PU2, a wafer to be polished is transferred to the pusher P2-1 from the transfer robot RB5, and after being polished, the wafer is transferred from the pusher P2-2 to the cleaning machine CL2-1 via the transfer robot RB4.

E. Serial Operation (2)

1. After it has been confirmed that the wafer 1 has been accurately transferred to the dry station in the wafer station 20, the transfer robot RB5 takes out the wafer 1 from the wafer station 20 and transfers the wafer 1 to the pusher P1-2.

2. At this time, the wafer carrier WC1-2*a* is at a position above the pusher P1-2 where a wafer can be transferred between the pusher P1-2 and the wafer carrier WC1-2*a*, while the wafer carrier WC1-2*b* is at the polishing position above the turntable TT1.

3. After it has been confirmed that the wafer 1 has been transferred to the pusher P1-2, the pusher P1-2 moves toward the wafer carrier WC1-2*a* until the wafer 1 comes into contact with wafer carrier WC1-2*a*.

4. Next, the wafer 1 is transferred to the wafer carrier WC1-2*a* by the action of a vacuum. After it has been confirmed that the wafer 1 has been transferred, the pusher P1-2 moves back to the previous position.

5. The wafer carrier WC1-2*a* pivots about the pivot shaft 33 through 180° in the horizontal direction to move to the polishing position and commences polishing. Meanwhile, as the pivot shaft 33 rotates, the wafer carrier WC1-2*b* moves to a position above the pusher P1-2 where a wafer can be transferred between the pusher P1-2 and the wafer carrier WC1-2*b*. A wafer 2 transferred to the pusher P1-2 in the same way as the above is transferred to the wafer carrier WC1-2*b* and held thereon under vacuum. The wafer carrier WC1-2*b* holding the wafer 2 stands by in this state.

6. Upon completion of the polishing of the wafer 1 held by the wafer carrier WC1-2*a*, the wafer carrier WC1-2*a* suction-holds the polished wafer 1 and is pivoted towards the pusher P1-2 to finally separate the wafer 1 from the polishing surface and reaches a position above the pusher P1-2.

7. The pusher P1-2 moves toward the wafer carrier WC1-2*a* and stops at a position where a predetermined spacing is left between the pusher P1-2 and the wafer carrier WC1-2*a*. Thereafter, the wafer carrier WC1-2*a* performs a wafer unloading operation to transfer the wafer 1 to the pusher P1-2. In this state, rinsing of the wafer 1 and rinsing of the wafer carrier WC1-2*a* are carried out. Meanwhile, as the pivot shaft 33 rotates, the wafer carrier WC1-2*b* moves to the polishing position, and polishing commences.

8. The transfer robot RB5 receives the wafer 1 from the pusher P1-2 by using the lower, wet hand. Next, the transfer robot RB5 transfers the wafer 1 to the wet station in the wafer station 20. After it has been confirmed that the wafer 1 has been accurately transferred to the wet station in the wafer station, the transfer robot RB5 takes out the wafer 1 from the wafer station 20 and transfers the wafer 1 to the pusher P2-1.

9. At this time, the wafer carrier WC2-1*a* lies at a position above the pusher P2-1 where a wafer can be transferred between the pusher P2-1 and the wafer carrier WC2-1*a*, while the wafer carrier WC2-1*b* lies at the polishing position above the turntable TT1.

10. After it has been confirmed that the wafer 1 has been transferred to the pusher P2-1, the pusher P2-1 moves toward the wafer carrier WC2-1*a* until the wafer 1 comes into contact with wafer carrier WC2-1*a*.

11. Next, the wafer 1 is transferred to the wafer carrier WC2-1*a* by the action of a vacuum. After it has been confirmed that the wafer 1 has normally been transferred, the pusher P2-1 moves back to the previous position.

12. The wafer carrier WC2-1*a* pivots about the pivot shaft 33 through 180° in the horizontal direction to move to the polishing position and commences polishing. Meanwhile, as the pivot shaft 33 rotates, the wafer carrier WC2-1*b* moves to a position above the pusher P2-1 where a wafer can be transferred between the pusher P2-1 and the wafer carrier WC2-1*b*. A wafer 2 transferred to the pusher P2-1 in the same way as the above is transferred to the wafer carrier WC2-1*b* and held thereon under vacuum. The wafer carrier WC2-1*b* holding the wafer 2 stands by in this state.

13. Upon completion of the polishing of the wafer 1 held by the wafer carrier WC2-1*a*, the wafer carrier WC2-1*a* suction-holds the polished wafer 1 and is pivoted towards the pusher P2-1 to finally separate the wafer 1 from the polishing surface and reaches a position above the pusher P2-1 where the wafer 1 can be transferred between the wafer carrier WC2-1*a* and the pusher P2-1.

14. The pusher P2-1 moves toward the wafer carrier WC2-1*a* and stops at a position where a predetermined spacing is left between the pusher P2-1 and the wafer carrier WC2-1*a*. Thereafter, the wafer carrier WC2-1*a* performs a wafer unloading operation to transfer the wafer 1 to the pusher P2-1. In this state, rinsing of the wafer 1 and rinsing of the wafer carrier WC2-1*a* are carried out. Meanwhile, as the pivot shaft 33 rotates, the wafer carrier WC2-1*b* moves to the polishing position, and polishing is commenced.

15. The transfer robot RB5 receives the wafer 1 from the pusher P2-1 by using the lower, wet hand. The transfer robot RB5 repeats this series of operations. Next, the transfer robot RB3 or RB4 transfers the wafer 1 to the cleaning machine CL1-1 or CL2-1.

Thus, in the above-described operation, a single wafer is polished sequentially in the two polishing units PU1 and PU2. Accordingly, it is possible to subject a single wafer to two different kinds of polishing successively in the two polishing units PU1 and PU2, for example, rough polishing in the polishing unit PU1 and finish polishing in the polishing unit PU2, by making the polishing units PU1 and PU2 different from each other in the kind of polishing cloth or abrasive fitted to the upper surfaces of the turntables TT1 and TT2 or supplying different polishing liquids to the upper surfaces of the turntables TT1 and TT2.

Figure 6:
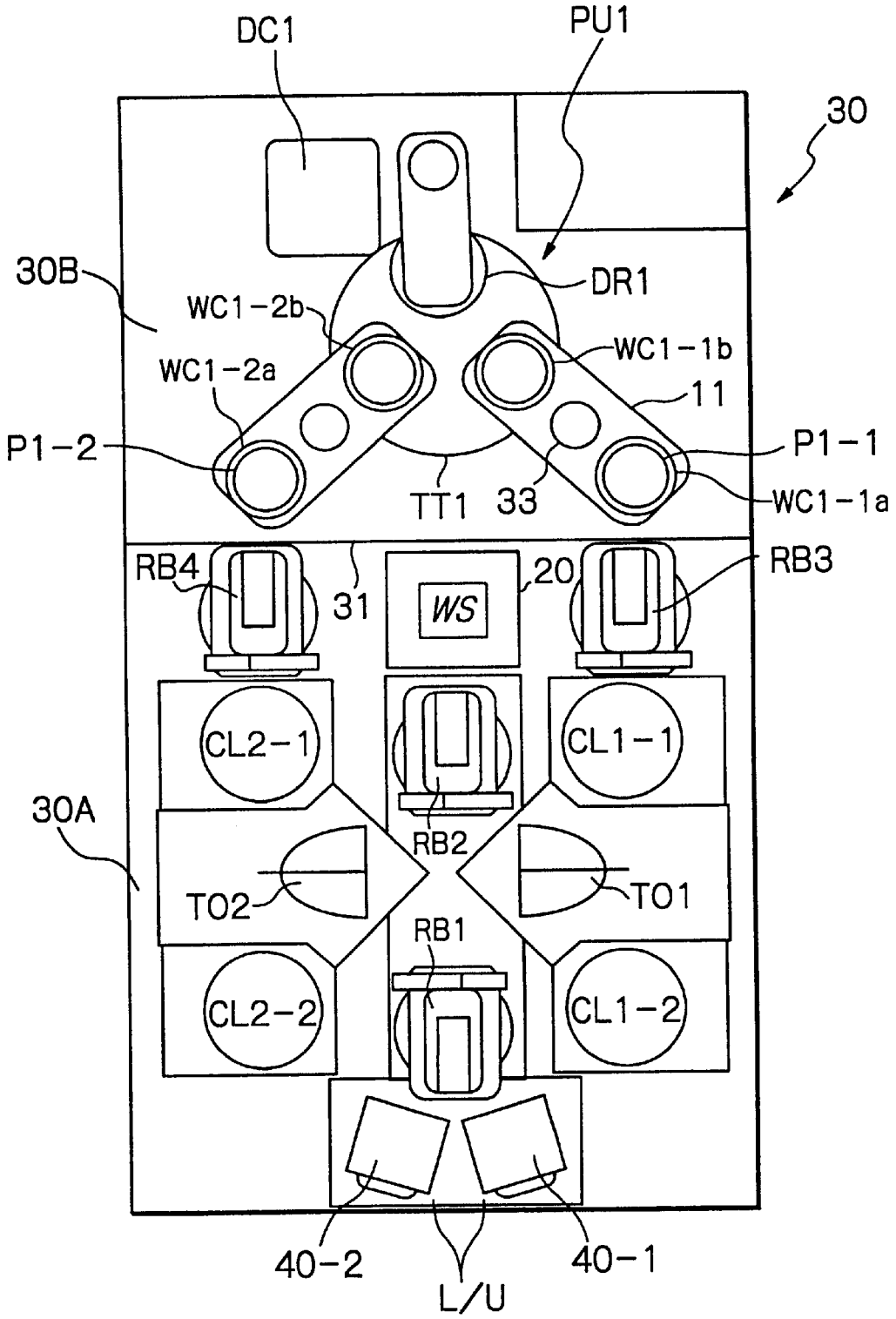
FIG. 6 is a plan view showing the arrangement of each part of a fourth embodiment of the polishing apparatus according to the present invention.

FIG. 6 is a plan view showing the arrangement of each part of a fourth embodiment of the polishing apparatus according to the present invention.

The embodiment shown in FIG. 6 has only one of the two polishing units PU1 and PU2 in the embodiment shown in FIG. 5, that is, the polishing unit PU1. The turntable TT1 of the polishing unit PU1 is disposed at a position facing the wafer station 20 across the partition 31. Further, transfer robots RB3 and RB4, which do not travel, are placed in between the pushers P1-1 and P1-2 on the one hand, which are provided in the polishing unit PU1, and the cleaning machines CL1-1 and CL2-1 on the other, which are placed in the cleaning chamber 30A. The arrangement of the rest of this embodiment is the same as that in the embodiment shown in FIG. 5.

The operation of the entire polishing apparatus according to the embodiment shown in FIG. 6 is substantially the same as the operation of one side of the polishing apparatus according to the embodiment shown in FIG. 5. Therefore, a description thereof is omitted.

As has been stated above, the present invention makes it possible to polish work-pieces, e.g. semiconductor wafers, at all times by using a single polishing turntable and hence possible to markedly increase the number of work-pieces polished per unit of time (i.e. throughput).

It is also possible according to the present invention to choose between a first method wherein work-pieces are alternately polished one by one on one turntable and a second method wherein two work-pieces are simultaneously polished on one turntable. In a case where the simultaneous polishing of two work-pieces by the second method causes the process to become unstable and thus brings about adverse effects, e.g. unfavorably low yield, the adverse effects produced by the simultaneous polishing can be eliminated by employing the first polishing method.

It should be noted that the present invention is not limited to the foregoing embodiments but can be modified in a variety of ways.

What is claimed is:

1. A polishing apparatus comprising:

a polishing unit including a turntable provided on one side surface with a polishing surface; and first and second substrate carriers each adapted to hold a substrate and to bring the substrate into contact with the polishing surface;

wherein each of the first and second substrate carriers is movable between a first position where the substrate carrier receives a substrate and a second position where the substrate carrier is positioned over the polishing surface and is able to bring the substrate into contact with the polishing surface of the turntable, and the first substrate carrier is movable between its first and second positions stated above while said second substrate carrier is positioned at its second position and vice versa;

wherein the second positions of the first and second substrate carriers are so arranged that the substrates held by the first and second substrate carriers in their second positions do not overlap each other; and wherein the polishing unit comprises a substrate transfer device capable of receiving substrates to be polished and positioning the substrates to enable both the first and second substrate carriers to pick up and hold the substrates from said substrate transfer device.

2. A polishing apparatus according to claim 1, including first and second pivotal arms which support the first and second substrate carriers, respectively, to enable the first and second substrate carriers to move between their first and second positions stated above.

3. A polishing apparatus according to claim 1, wherein the second position includes a polishing position where the substrate held by the substrate carrier is kept in contact with the polishing surface of the turntable and a waiting position where the substrate held by the substrate carrier is spaced away from the polishing surface.

4. A polishing apparatus according to claim 1, wherein the substrate transfer device is adapted to receive substrates which have been polished from the first and second substrate carriers positioned at their first positions.

5. A polishing apparatus according to claim 1, comprising a plurality of the polishing units.

6. A polishing apparatus comprising:

a polishing unit including a turntable provided on one side surface with a polishing surface; and first and second substrate carrier means each including a pivotal shaft, an arm having a center portion supported by the pivotal arm and opposite ends, and first and second substrate carriers provided on the opposite ends of the arm which are adapted to hold substrates, respectively;

wherein each of the arms of the first and second substrate carrier means is pivotable about the pivotal shafts in such a manner that, in a first pivotal position, one of the first and second substrate carriers receives a substrate to be polished, while the other of the first and second substrate carriers is positioned over the polishing surface to enable said other of the first and second substrate carriers to bring the substrate held thereby into contact with the polishing surface of the turntable, and in a second pivotal position, said other of the first and second substrate carriers stated above receives a substrate to be polished, while said one of the first and second substrate carriers stated above is positioned over the polishing surface to enable said one of the first and second substrate carriers to bring the substrate held thereby into contact with the polishing surface of the turntable, the arms being movable between their first and second positions stated above without contacting each other.

7. A polishing apparatus according to claim 6, wherein the polishing unit includes a first substrate transfer device for receiving substrates to be polished and positioning the substrates to enable the first and second substrate carriers of the first substrate carrier means to pick up and hold the substrates and a second substrate transfer device for receiving substrates to be polished and positioning the substrates to enable the first and second substrate carriers of the second carrier means to pick up and hold the substrates.

8. A polishing apparatus according to claim 7, wherein the first substrate transfer device is adapted to receive substrates which have been polished from the first and second substrate carriers of the first carrier means and the second substrate transfer device is adapted to receive substrates which have been polished from the first and second substrate carriers of the second carrier means.

9. A polishing apparatus according to claim 7, comprising a plurality of the polishing units.

10. A polishing method comprising the steps of:

providing a turntable provided on its one side surface with a polishing surface;

providing first and second substrate carriers each adapted to hold a substrate and to bring the substrate into contact with said polishing surface;

turning the turntable;

holding a substrate by the first substrate carrier;

moving the first substrate carrier to bring the substrate held thereby into contact with the polishing surface to subject the substrate to polishing; and holding a substrate and then positioning the substrate over the polishing surface by the second substrate carrier, while the first substrate carrier keeps the substrate held thereby in contact with the polishing surface, whereby following completion of the polishing of the substrate held by the first substrate carrier, the substrate held by the second substrate carrier can be brought into contact with the polishing surface to subject the substrate to polishing without delay.

11. A polishing method according to claim 10, further comprising:

dressing the polishing surface while the substrate is being polished.

* * * * *